US010750924B2

(12) United States Patent
Roderick et al.

(10) Patent No.: US 10,750,924 B2
(45) Date of Patent: Aug. 25, 2020

(54) DISHWASHER WITH TUBE WASH SYSTEM

(71) Applicant: Whirlpool Corporation, Benton Harbor, MI (US)

(72) Inventors: Frederick T. Roderick, Coloma, MI (US); Antony M. Rappette, Benton Harbor, MI (US); Daniel Lottinville, Benton Harbor, MI (US); David Brightbill, Benton Harbor, MI (US); Matthew Jaske, Berrien Springs, MI (US); Rodney Welch, Eau Claire, MI (US); Michael Lagness, Bridgman, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 267 days.

(21) Appl. No.: 15/079,167

(22) Filed: Mar. 24, 2016

(65) Prior Publication Data

US 2017/0273535 A1 Sep. 28, 2017

(51) Int. Cl.
*A47L 15/22* (2006.01)
*A47L 15/23* (2006.01)
(Continued)

(52) U.S. Cl.
CPC ..... *A47L 15/22* (2013.01); *A47L 15/23* (2013.01); *A47L 15/4261* (2013.01);
(Continued)

(58) Field of Classification Search
CPC ..... A47L 15/23; A47L 15/508; A47L 15/16; A47L 15/4282; A47L 15/4278; B05B 1/20; B05B 3/06; B05B 3/0486
(Continued)

(56) References Cited

U.S. PATENT DOCUMENTS 1,701,066 A * 2/1929 Elkington ..... A47L 15/23 239/97
2,016,880 A * 10/1935 Ward, Jr. ..... A47L 15/23 239/259
(Continued)

FOREIGN PATENT DOCUMENTS

EP 2454983 A1 5/2012
GB 2322067 A1 8/1998
(Continued)

OTHER PUBLICATIONS

Kamoto, Sadamu; "Attaching Structure for Cap Member in Washing Nozzle", Sep. 1999, JP 11253381 A—Machine Translation (Year: 1999).*
(Continued)

*Primary Examiner* — David G Cormier
*Assistant Examiner* — Thomas Bucci
(74) *Attorney, Agent, or Firm* — McGarry Bair PC

(57) ABSTRACT

A dishwasher for treating dishes according to an automatic cycle of operation includes a tub at least partially defining a treating chamber with an access opening, a sump fluidly coupled to the tub, and a liquid recirculation circuit fluidly coupling the sump to the treating chamber. The liquid recirculation circuit includes at least one rotating spray tube having a longitudinal body axis defining a rotational axis. A plurality of spray nozzles are provided in the rotating spray tube.

17 Claims, 5 Drawing Sheets

(51) Int. Cl.
*A47L 15/42* (2006.01)
*A47L 15/50* (2006.01)

(52) U.S. Cl.
CPC ..... *A47L 15/4278* (2013.01); *A47L 15/4282* (2013.01); *A47L 15/507* (2013.01)

(58) Field of Classification Search
USPC ..... 134/198, 56 D, 176, 172, 179, 144, 177, 134/111, 183, 199, 103.2, 148, 99.1; 239/251, 227, 261, 568, 567, DIG. 1, 239/225.1
See application file for complete search history.

(56) References Cited

U.S. PATENT DOCUMENTS 2,031,816 A * 2/1936 Blakeslee ..... A47L 15/20 134/99.1
2,723,882 A * 11/1955 Barnett ..... A01C 23/047 239/550
2,734,520 A * 2/1956 Abresch et al. .... A47L 15/4202 134/174
2,910,207 A * 10/1959 Andrew ..... A47L 15/50 220/488
2,956,572 A * 10/1960 Levit ..... A47L 15/23 134/176
2,973,907 A * 3/1961 Abresch ..... A47L 15/23 239/261
2,980,120 A * 4/1961 Jacobs ..... A47L 15/4289 134/57 D
2,998,934 A * 9/1961 Broughton ..... B05B 15/50 239/521
3,006,557 A * 10/1961 Jacobs ..... A47L 15/18 239/227
3,051,183 A * 8/1962 Jacobs ..... A47L 15/23 134/174
3,064,665 A * 11/1962 Martiniak ..... A47L 15/4289 134/176
3,146,953 A * 9/1964 Komanns ..... A47L 15/22 239/102.1
3,176,697 A * 4/1965 Gibson ..... A47L 15/0089 134/183
3,210,010 A * 10/1965 Devereux Delapena ..... A47L 15/18 239/242
3,213,866 A 10/1965 Martiniak
3,342,421 A * 9/1967 Schutte ..... A47L 15/23 239/468
3,348,775 A * 10/1967 La Flame ..... A47L 15/23 239/227
4,064,887 A * 12/1977 Geiger ..... A47L 15/23 134/144
4,257,559 A * 3/1981 Noren ..... A47L 15/16 239/283
4,405,087 A * 9/1983 Mata-Garza ..... A01M 7/0092 137/890
4,582,259 A * 4/1986 Hoover ..... A47L 15/42 239/251
4,735,222 A * 4/1988 Crane ..... A47L 15/241 134/172
4,836,230 A * 6/1989 Elliott ..... A47L 15/0089 134/138
5,582,742 A * 12/1996 Wilkie ..... B04B 11/06 210/360.1
5,927,616 A * 7/1999 Grise ..... A47L 15/4278 134/201
5,944,037 A * 8/1999 Sinyong ..... A47L 15/23 134/176
5,964,232 A * 10/1999 Chung ..... A47L 15/23 134/176
6,969,029 B2 3/2005 Ochoa, Sr. et al.
6,955,179 B2 * 10/2005 Ecker ..... A47L 15/248 134/133
9,010,345 B2 4/2015 Mitchell et al.
2003/0183255 A1 * 10/2003 Kim ..... A47L 15/4278 134/198
2003/0192578 A1 * 10/2003 Ochoa, Sr. ..... A47L 15/508 134/176
2007/0006903 A1 * 1/2007 Koch ..... A47L 15/508 134/56 D
2007/0158472 A1 * 7/2007 Calhoun ..... B05B 1/20 239/464
2007/0246078 A1 * 10/2007 Purtilo ..... A47L 15/14 134/25.2
2007/0289615 A1 * 12/2007 Shin ..... A47L 15/23 134/56 D
2008/0163904 A1 7/2008 Hwang
2008/0169009 A1 * 7/2008 Mailander ..... A47L 15/502 134/135
2008/0173730 A1 * 7/2008 Clavelle ..... A47L 15/16 239/261
2009/0255560 A1 * 10/2009 Lehmann ..... A47L 15/4278 134/198
2011/0203619 A1 * 8/2011 Kara ..... A47L 15/4289 134/174
2012/0138092 A1 * 6/2012 Ashrafzadeh ..... A47L 15/4295 134/18
2012/0175431 A1 * 7/2012 Althammer ..... B05B 1/20 239/263
2012/0285490 A1 * 11/2012 Blanchard ..... A47L 15/0018 134/25.2
2012/0325277 A1 * 12/2012 Mitchell ..... A47L 15/4282 134/198
2015/0007861 A1 * 1/2015 Azmi ..... A47L 15/20 134/172
2015/0366430 A1 * 12/2015 Ross ..... A47L 15/428 134/169 R
2016/0058264 A1 * 3/2016 Thiyagarajan ..... A47L 15/22 134/172
2016/0198927 A1 * 7/2016 Boyer ..... A47L 15/23 134/172

FOREIGN PATENT DOCUMENTS

JP 11253381 A * 9/1999
JP H11253381 A1 9/1999
KR 20050122359 A 12/2005

OTHER PUBLICATIONS

European Search Report filed May 11, 2017.

* cited by examiner

DISHWASHER WITH TUBE WASH SYSTEM

BACKGROUND OF THE INVENTION

Contemporary automatic dishwashers for use in a typical household include a tub and at least one rack or basket for supporting soiled dishes within the tub. At least an upper rack and a lower rack for holding dishes to be cleaned are typically provided within the treating chamber. A silverware basket for holding utensils, silverware, etc. is also usually provided and normally removably mounts to the door or within the lower rack.

A spraying system can be provided for recirculating liquid throughout the tub to remove soils from the dishes. The spraying system can include various sprayers, including one or more rotatable sprayers. Various sprayers of the spraying system can be configured to spray toward the racks or silverware basket. One specific type of sprayer that can be included within the spraying system is a rotating spray tube having a plurality of spray holes or nozzles.

BRIEF DESCRIPTION OF THE INVENTION

The invention relates to a dishwasher for treating dishes according to an automatic cycle of operation. In one aspect of the invention, the dishwasher includes a tub at least partially defining a treating chamber with an access opening, a sump fluidly coupled to the tub, and a liquid recirculation circuit fluidly coupling the sump to the treating chamber. The liquid recirculation circuit includes at least one rotating spray tube having a longitudinal body axis defining a rotational axis. A plurality of spray nozzles are provided in the rotating spray tube and are arranged in a spiral pattern about the longitudinal axis.

In another aspect of the invention, the dishwasher includes a tub having at least one wall partially defining a treating chamber with an access opening, a sump fluidly coupled to the tub, and a liquid recirculation circuit fluidly coupling the sump to the treating chamber. The liquid recirculation circuit includes at least one rotating spray tube located adjacent the at least one wall. The at least one rotating spray tube has a longitudinal body axis defining a rotational axis and a plurality of spray nozzles provided in the rotating spray tube. The liquid recirculation circuit further includes a pump drawing liquid from the sump and pumping the drawn liquid to the at least one rotating spray tube. The nozzles are arranged in a non-linear pattern on the rotating spray tube such that the flow of liquid leaving the nozzles and running down the at least one wall to the sump does not exceed the pump's capacity to draw liquid from the sump.

DETAILED DESCRIPTION OF EMBODIMENTS OF THE INVENTION

Figure 1:
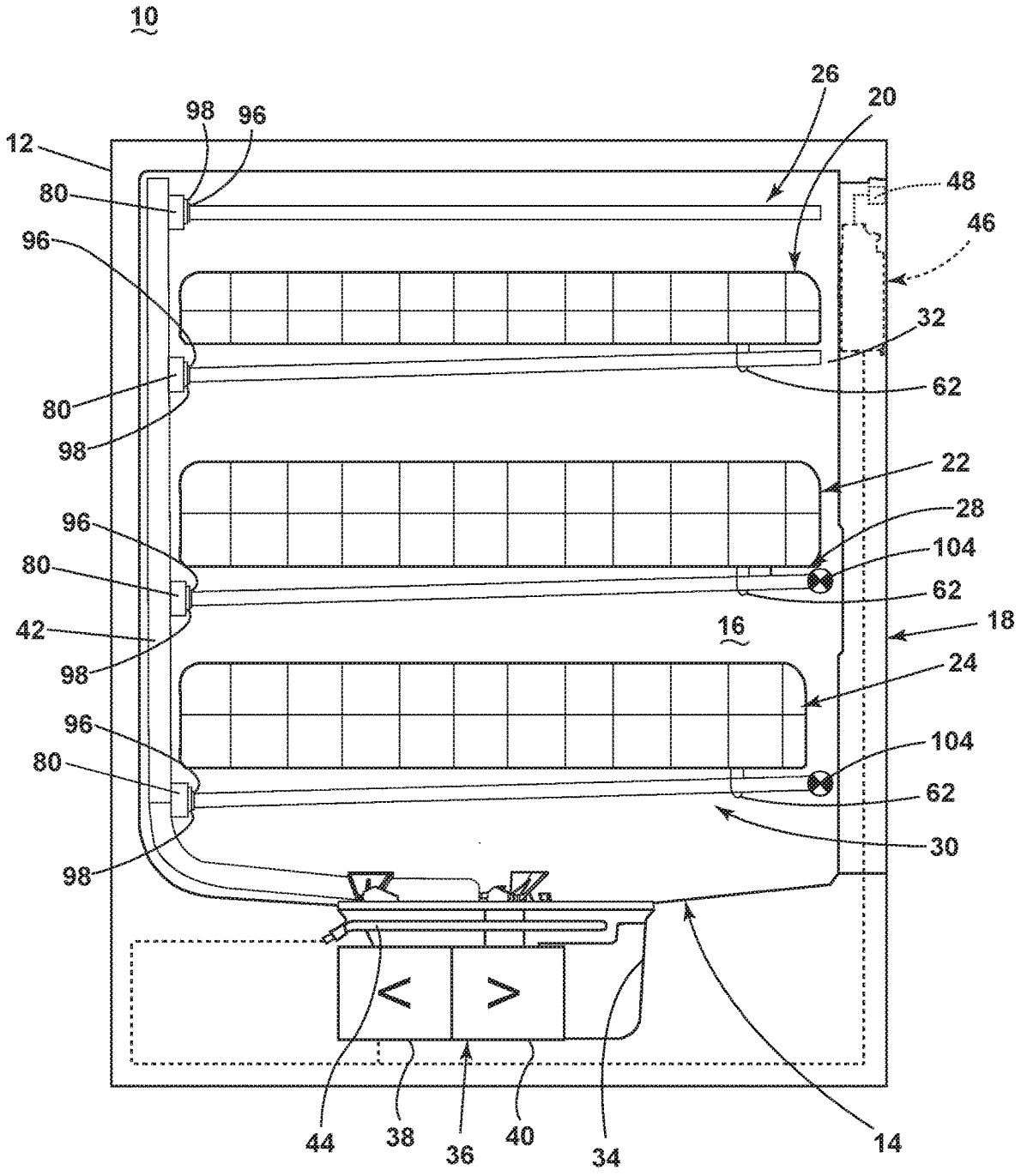
FIG. 1 is a schematic, cross-sectional view of a dishwasher with a spraying system according to an embodiment of the invention.

FIG. 1 illustrates a schematic, cross-sectional view of an exemplary automated dishwasher 10 according to an embodiment of the invention. The dishwasher 10 shares many features of a conventional automated dishwasher, which will not be described in detail herein except as necessary for a complete understanding of the invention. A chassis 12 can define an interior of the dishwasher 10 and can include a frame, with or without panels mounted to the frame. For built-in dishwashers, outer panels are typically not needed. For dishwashers that are not built into existing cabinetry, the chassis 12 can include the panels mounted to the frame to form a cabinet for the dishwasher 10. An open-faced tub 14 can be provided within the chassis 12 and can at least partially define a treating chamber 16 for washing or otherwise treating dishes. The open face of the tub 14 defines an access opening for the treating chamber 16.

A closure element, such as a door assembly 18, can be movably mounted to the dishwasher 10 for movement between opened and closed positions to selectively open and close the treating chamber access opening defined by the open face of the tub 14. Thus, the door assembly 18 provides accessibility to the treating chamber 16 for the loading and unloading of dishes or other washable items. It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open. Alternatively, the closure element can be slidable relative to the chassis 12, such as in a drawer-type dishwasher, wherein the access opening for the treating chamber 16 is formed by an open-top tub. Other configurations of the closure element relative to the chassis 12 and the tub 14 are also within the scope of the invention.

Dish holders, illustrated in the form of upper, middle, and lower dish racks 20, 22, 24, can be located within the treating chamber 16 and receive dishes for treatment, such as washing. The upper, middle, and lower racks 20, 22, 24 are typically mounted for slidable movement in and out of the treating chamber 16 for ease of loading and unloading. Other dish holders can be provided, such as a silverware basket, separate from or integral with any of the upper, middle, and lower racks 20, 22, 24. As used in this description, the term "dish(es)" is intended to be generic to any item, single or plural, that may be treated in the dishwasher 10, including, without limitation, dishes, plates, pots, bowls, pans, glassware, and silverware. While the dishwasher 10 is illustrated herein as having three dish racks 20, 22, 24, it will be understood that any suitable number and configuration of dish racks is also within the scope of the invention.

A spray system can be provided for spraying liquid in the treating chamber 16 and can be provided, for example, in the form of an upper spray tube 26, an upper middle spray tube 32, a lower middle spray tube 28, and a lower spray tube 30. The upper spray tube 26, the upper middle spray tube 32, and the lower middle spray tube 28 are located, respectively, above the upper rack assembly 20, above the middle rack assembly 22, and above the lower rack assembly 24. The lower spray tube 30 is located beneath the lower rack assembly 24. By example, the illustrated spray tubes 26, 28, 30, 32 each include a connector 96 located at the rear end of the spray tube 26, 28, 30, 32 and adapted to mate or dock with a header 98 that is provided on a manifold 80. The manifold 80 can be mounted at the rear of the tub 14, such as to a supply tube 42, or in any other suitable location.

Figure 7:
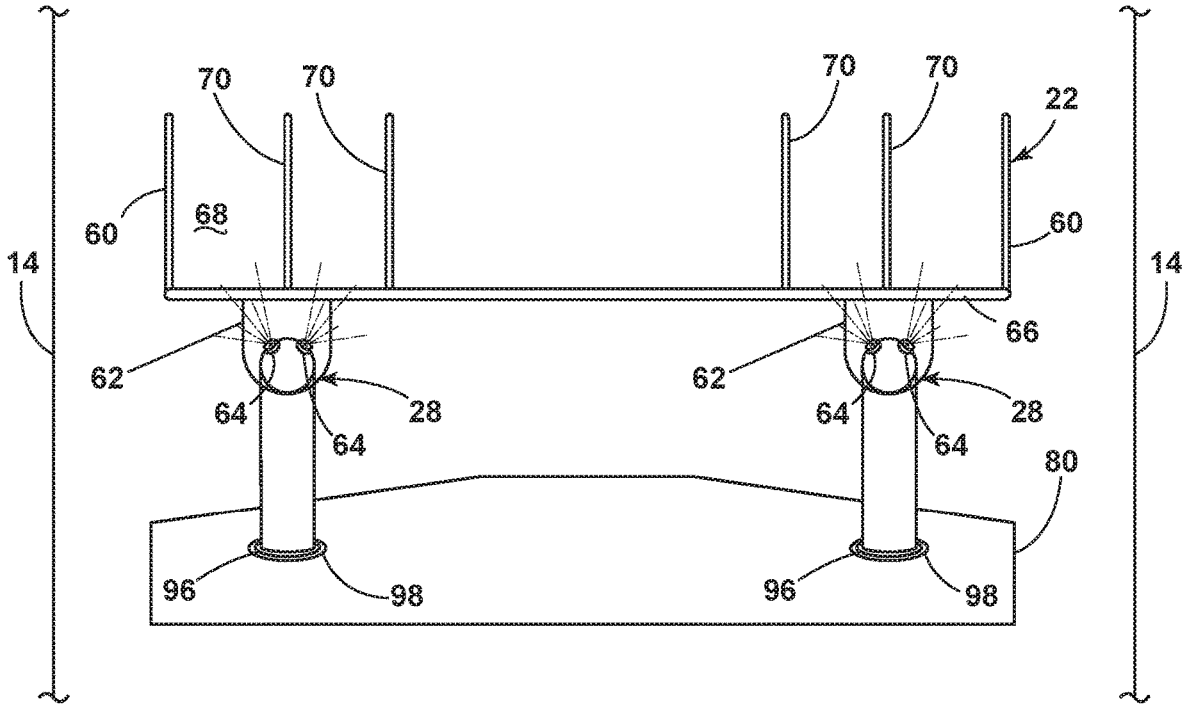
FIG. 7 is a schematic front view of a dish rack and spray tube for use in the dishwasher of FIG. 1 according to an embodiment of the invention.

It will be further understood that the spray tubes 26, 28, 30, 32, while illustrated as being positioned beneath a central region of the dish racks 20, 22, 24, can also be provided adjacent the opposing walls of the tub 14. Further, at least two of the spray tubes 26, 28, 30, 32 can be adjacent different ones of the at least two opposing walls of the tub 14, even being provided in such a configuration that the at least two spray tubes 26, 28, 30, 32 are provided adjacent opposing side walls as well as adjacent to the bottom of the same dish rack 20, 22, 24, as is shown in FIG. 7. It will also be understood that each of the levels of spray tubes 26, 28, 30, 32 can comprise multiple spray tubes 26, 28, 30, 32 provided in parallel with one another and spread out horizontally across the width of the manifold 80, which can extend generally from one side wall to another side wall of the tub 14.

The spray tubes 26, 28, 30, 32 can be provided at an angle relative to the rack assemblies 20, 22, 24. In an exemplary embodiment, a front or second end of the spray tube 26, 28, 30, 32 can be positioned in a higher position than the first or rear end of the spray tube 26, 28, 30, 32 where the connector 96 is located. While the spray tubes 28, 30, 32 are illustrated herein as being positioned at an angle, it will be understood that the angle of the spray tubes 26, 28, 30, 32 can be any suitable angle relative to the plane of the rack assemblies 20, 22, 24, including a zero degree angle, or the spray tubes 26, 28, 30, 32 can be provided in a horizontal position at a 90 degree angle. Further, the spray tubes 26, 28, 30, 32 need not be provided at identical angles, and any combination of angles of the spray tubes 26, 28, 30, 32 is also within the scope of the invention.

The spray assemblies 26, 28, 30, 32 are illustrated as spray tubes by example but are not limited to only tubes. For example, the spray assemblies 26, 28, 30, 32 could comprise a combination of rotating spray arms and rotating or stationary spray tubes. Furthermore, the spray system can include additional and/or alternative spray assemblies. For example, a distribution header or spray manifold can be located at the rear of the tub 14 at any vertical position. An exemplary spray manifold is set forth in detail in U.S. Pat. No. 7,594,513, issued Sep. 29, 2009, and titled "Multiple Wash Zone Dishwasher," which is incorporated herein by reference in its entirety.

A recirculation system can be provided for recirculating liquid from the treating chamber 16 to the spray system. The recirculation system can include a sump 34 and a pump assembly 36. The sump 34 collects the liquid sprayed in the treating chamber 16 and can be formed by a sloped or recess portion of a bottom wall of the tub 14. The pump assembly 36 can include both a drain pump 38 and a recirculation pump 40. The drain pump 38 can draw liquid from the sump 34 and pump the liquid out of the dishwasher 10 to a household drain line (not shown). The recirculation pump 40 can draw liquid from the sump 34, and the liquid can be simultaneously or selectively pumped through a supply conduit or tube 42, into the manifold 80, and then distributed to each of the spray tubes 26, 28, 30, 32 for selective spraying. The supply tube 42 and manifold 80 extend along a wall of the tub 14 and fluidly connect the pump assembly 36 to the at least one spray tube 26, 28, 30, 32.

While not shown, a liquid supply system can include a water supply conduit coupled with a household water supply for supplying water to the treating chamber 16. A heating system including a heater 44 can be located, for example, within the sump 34 for heating the liquid contained in the sump 34.

A control system including a controller 46 can also be included in the dishwasher 10, which can be operably coupled with various components of the dishwasher 10 to implement a cycle of operation. The controller 46 can be located within the door assembly 18 as illustrated, or it can alternatively be located somewhere within the chassis 12. The controller 46 can also be operably coupled with a control panel or user interface 48 for receiving user-selected inputs and communicating information to the user. The user interface 48 can include operational controls such as dials, lights, switches, and displays enabling a user to input commands, such as a cycle of operation, to the controller 46 and receive information.

Figure 2:
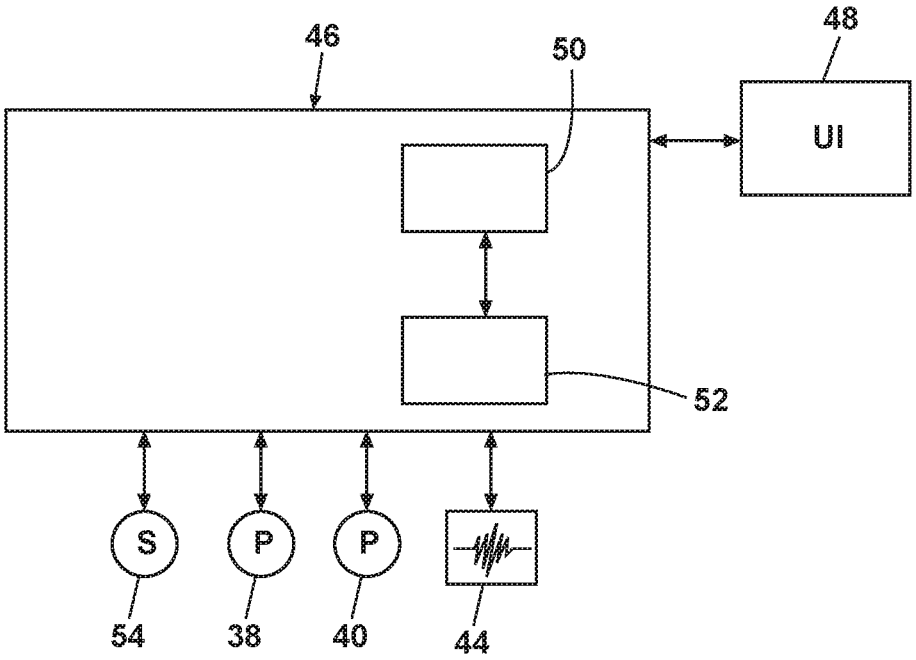
FIG. 2 is a schematic view of a control system for the dishwasher of FIG. 1.

As illustrated schematically in FIG. 2, the controller 46 can be coupled with the heater 44 for heating the wash liquid during a cycle of operation, the drain pump 38 for draining liquid from the treating chamber 16, and the recirculation pump 40 for recirculating the wash liquid during the cycle of operation. The controller 46 can be provided with a memory 50 and a central processing unit (CPU) 52. The memory 50 can be used for storing control software that can be executed by the CPU 52 in completing a cycle of operation using the dishwasher 10 and any additional software. For example, the memory 50 can store one or more pre-programmed cycles of operation that can be selected by a user and completed by the dishwasher 10. The controller 46 can also receive input from one or more sensors 54. Non-limiting examples of sensors that can be communicably coupled with the controller 46 include a temperature sensor and turbidity sensor to determine the soil load associated with a selected grouping of dishes, such as the dishes associated with a particular area of the treating chamber 16.

The dishwasher 10 can include all of the above exemplary systems, a selection of the above exemplary systems, and/or other systems not listed above as desired. Further, some of the systems can be combined with other systems and/or can share components with other systems. Examples of other systems that the dishwasher can further include are a dispensing system that supplies one or more treating agents or chemistries to the treating chamber 16 and an air supply system that may provide air, which can be heated or not heated, to the treating chamber 16, such as for drying and/or cooling the dishes. An exemplary air supply system is set forth in U.S. patent application Ser. No. 12/959,673, filed Dec. 3, 2010 and published as U.S. Patent Application Publication No. 2012/0138106 on Jun. 7, 2012, both of which are incorporated herein by reference in their entireties.

Figure 3:
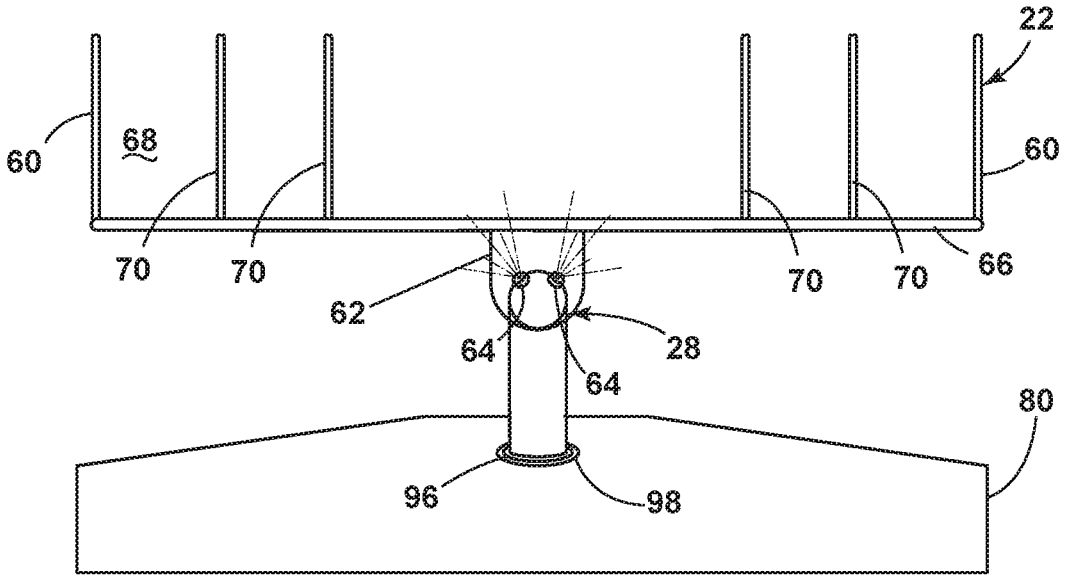
FIG. 3 is a schematic front view of a dish rack and spray tube for use in the dishwasher of FIG. 1.

Referring now to FIG. 3, a front view of an exemplary dish rack 22 and spray tube 28 is illustrated. The dish rack 22 can be constructed of a wire frame effectively forming opposing side walls 60, front and rear walls (not shown), and a bottom wall 66 that together define an open-top holding compartment 68. The bottom wall 66 can be completely flat, as illustrated by example, to form a flat bottom dish rack or it can have a varied configuration comprising a plurality of inclined and, possibly, flat walls that effectively forms an overall horizontal bottom of an inclined bottom. Additionally, a plurality of supports 70, such as panels, tines, or other structures, can extend upwardly from the bottom wall 66 and/or the side walls 60, or the front and rear walls (not shown) to support various dish items.

The dish rack 22 can be equipped with the spray tube 28 adapted to provide treating liquid to dish items placed on the dish rack 22. The spray tube 28 can be stationary or can selectively rotate about its longitudinal axis. By rotating the spray tube 28, the treating liquid can be sprayed in multiple spray angles and trajectories. In the case that the spray tube 28 is rotatable, rotation of the spray tube 28 can be driven by a single drive mechanism that is coupled directly to the spray tube 28. It will also be understood that rotations of a plurality of spray tubes 26, 28, 30, 32 can be driven concurrently by a single unified drive mechanism that can control the rotation of multiple spray tubes 26, 28, 30, 32 by the use of, for example, a series of gears that connects the spray tubes 26, 28, 30, 32 and drives them all to rotate in parallel. The mechanism or actuator for driving the rotation of the spray tubes 26, 28, 30, 32, either in series or individually, can be any suitable driving mechanism, non-limiting examples of which include an electric or hydraulic motor selectively operable to directly drive rotation of one or more spray tubes 26, 28, 30, 32 or a gear assembly, which could be provided in the form of a worm gear assembly, spur gears, etc. Nozzles on the spray tube 28 may be oriented such that the spray itself may cause the spray tube 28 to rotate.

The dish rack 22 is provided with an attachment mechanism 62 that extends downwardly from the bottom wall 66 of the dish rack 22 to attach to and support the spray tube 28. The attachment mechanism 62 can be any suitable shape that provides support for the front end of the spray tube 28 and allows for selective rotation of the spray tube 28. Non-limiting examples of such an attachment mechanism include a hook, a hanger, a bracket, etc.

The spray tube 28 can be fixedly mounted to the dish rack 22 by the attachment mechanism 62 for movement therewith when the dish rack 22 is slid relative to the tub 14, or the spray tube 28 can be fixedly mounted to the tub 14 so as to retain its position relative to the tub 14 upon movement of the dish rack 20. In the former case, the spray tube 28 can dock with the supply tube 42 (FIG. 1) or other structure of the liquid supply and/or recirculation systems, such as the manifold 80, when the dish rack 22 is slid to its most rearward position in the tub 14 to establish fluid communication with the liquid supply and/or recirculation systems. By example, the connector 96 (FIG. 1) located at the rear end of the spray tube 28 can be adapted to selectively mate or dock with the header 98 (FIG. 1) provided on the manifold 80. The manifold 80 can be adapted to selectively mate or dock with the supply tube 42.

The spray tube 28 can be provided with a plurality of spray nozzles 64 that can be positioned to spray treating liquid onto the dish items contained within the holding compartment 68 of the dish rack 22. The spray nozzles 64 can be provided along the length of the spray tube 28 in any suitable configuration, which will be described in more detail below. The spray nozzles 64 can be provided on or slightly lifted away from the surface of the spray tube 28, or they can be indented or recessed into the surface of the spray tube 28. The volume and velocity of the treating liquid emitted from the spray nozzles 64 can be based on the type of dish item contained within the dish rack 22, can be generic for all types of dish items, and/or can be variable from one treating cycle of operation to another and/or within a single treating cycle of operation. Additionally, the spray nozzles 64 can spray liquid alternately (e.g., between rows—one row at a time wherein the rows are sequenced on and off, within rows—sets of nozzles 64 within a row sequenced on and off), continuously, and/or intermittently.

Figure 4:
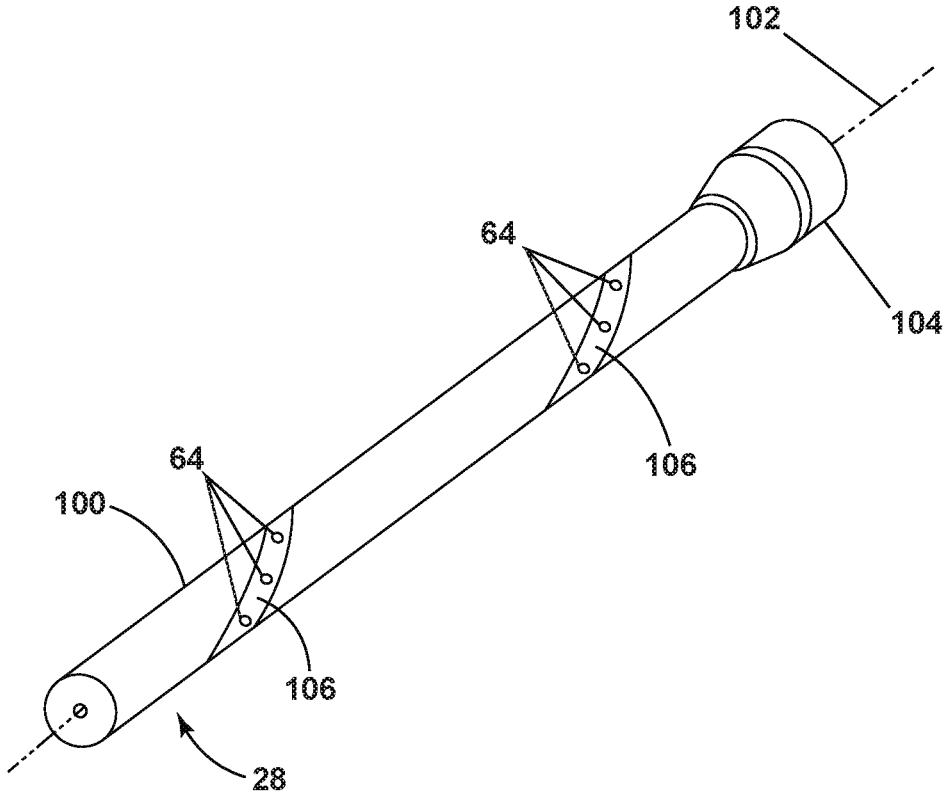
FIG. 4 is an enlarged perspective view of a rotating spray tube of FIG. 3.

FIG. 4 illustrates an enlarged perspective view of an exemplary embodiment of the spray tube 28 for use in the dishwasher 10 according to the disclosure herein. It will be understood that the spray tube 28 having such a structure and design can be used at any suitable position within the dishwasher 10 and can be provided in any suitable quantity necessary within the dishwasher 10 for providing sufficient treating liquid to the dishes being treated. The spray tube 28 has a longitudinal body 100 that is provided as a hollow, cylindrical tube. The spray tube 28 has a longitudinal body axis 102 that defines a rotational axis for the spray tube 28.

The spray tube 28 can also be provided with a channel 106 provided on its surface. In an exemplary embodiment, the channel 106 spirals around the axis 102 of the spray tube 28 along the longitudinal length of the spray tube 28. The spiral channel 106 can include any suitable number of revolutions about the axis 102 of the spray tube 28. In an exemplary embodiment, the spiral channel 106 will complete at least one full revolution about the spray tube 28. The channel 106 can be a recessed channel 106 in the surface of the spray tube 28. It is also contemplated that the spray tube 28 can include an additional piece that wraps around the spray tube 28, non-limiting examples of which include a decorative piece, which can be formed of metal, and which covers the surface of the spray tube 28 where no nozzles 64 are present. The nozzles 64 for supplying treating liquid to dishes can also be arranged in a spiral pattern about the longitudinal axis 102 of the spray tube 28 with or without a channel. In an exemplary embodiment, the nozzles 64 are located within the spiral channel 106.

While the pattern of the nozzles 64 is illustrated as being a spiral pattern, it will also be understood that any suitable non-linear pattern of arrangement of the nozzles 64 is within the scope of the disclosure. By using a non-linear arrangement of the nozzles 64, over-accumulation of treating liquid in the sump 34 at one time can be avoided. When the flow of treating liquid leaving the nozzles 64 all runs down at least one wall of the tub 14 to the sump 34, the capacity of the pump assembly 36 to draw the liquid from the sump 34 can be exceeded. By varying the direction of the flow of treating liquid leaving the nozzles 64, the over-accumulation of treating liquid can be prevented. It will be further understood that the nozzles 64 could also be arranged in a linear pattern if the nozzles 64 were not all oriented to release the spray in a uniform or linear direction. By example, all of the nozzles 64 on a spray tube 28 could be provided in a single line along the length of the longitudinal axis 102 so long as the nozzles 64 provided in the line were oriented or angled in such a way that the nozzles 64 did not all release the spray in the same direction. By further example, the nozzles 64 could alternate orientations with the spray being directed in an opposite direction between the two possible orientations. Alternatively, the nozzles 64 could vary slightly down in their orientation down the length of the longitudinal axis 102 such that the nozzles 64 gradually change the direction in which the spray is released from one end of the spray tube 28 to the other end.

The spray tube 28 can also be provided with an end cap 104 provided at the front end of the spray tube 28. The end cap 104 at least selectively prevents treating liquid from exiting the spray tube 28 at the front end nearest the door assembly 18. In one embodiment, the end cap 104 can be a solid plug that does not permit any treating liquid from exiting the front end of the spray tube 28. In another embodiment, the end cap 104 can be provided as a drain valve that can selectively allow or prevent the escape of treating liquid from the front end of the spray tube 28. Any suitable type of drain valve can be used within the end cap 104, non-limiting examples of which include a flapper valve, check valve, or other type of pressurized valve.

Figure 5:
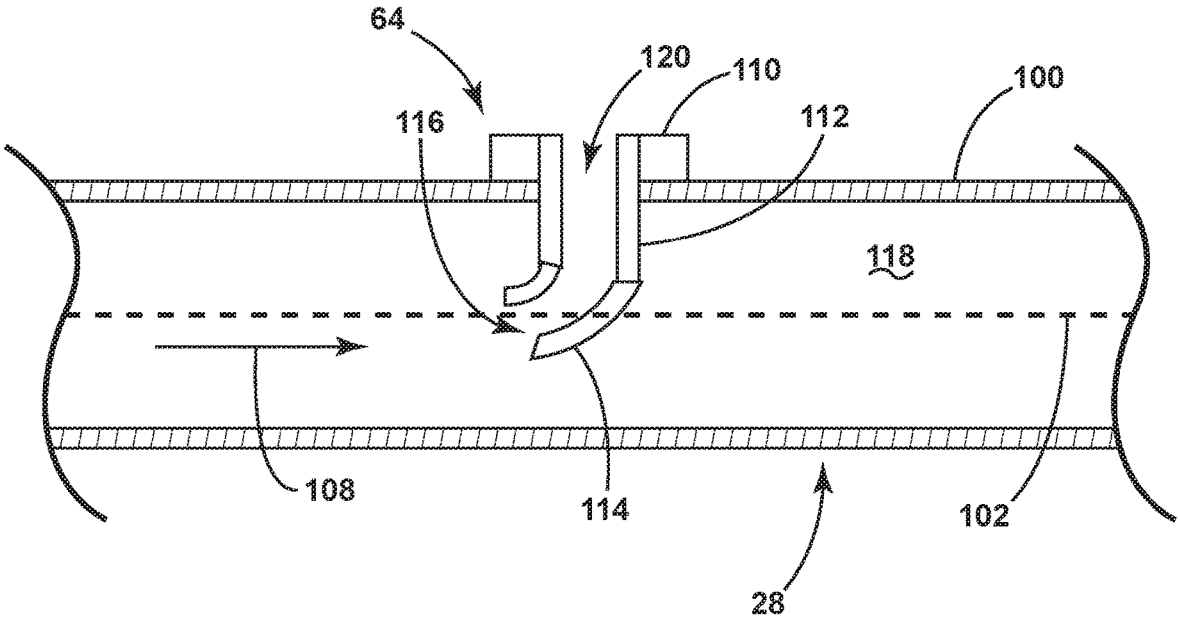
FIG. 5 is an enlarged schematic side view of a spray nozzle for use with the rotating spray tube of FIG. 4 according to an embodiment of the invention.

FIG. 5 illustrates an enlarged cross-sectional view of a design for a nozzle 64 according to an embodiment of the invention. The nozzle 64 comprises a head portion 110 and an inlet tube 112. The head portion 110 can have a cylindrical shape, a hexagonal shape, or any other suitable geometry. The inlet tube 112 extends from the exterior side of the spray tube 28, passing through an opening 120 in the spray tube 28, and into the interior 118 of the spray tube 28. The inlet tube 112 can have an angled or curved portion 114 that defines an inlet opening 116 into which treating liquid can flow. The angle of the curved portion 114 can be any suitable angle for directing a flow of water in the spray tube 28 into the inlet tube 112. The treating liquid flows from the back end to the front end of the spray tube 28 along the flow path indicated by the arrow 108. The inlet opening 116 of the inlet tube 112 faces the liquid flow path 108. Further, the inlet tube 112 and the angled portion 114 extend into the interior 118 of the spray tube 28 to an extent that the body axis 102 of the spray tube 28 passes through the inlet opening 116.

While the spray tube 28 is illustrated herein as having nozzles 64 placed within openings 120 to direct the flow of treating liquid out of the spray tube 28, in an additional embodiment of the invention, it is contemplated that the spray tube 28 could be provided only with openings 120 not having nozzles 64 placed within the openings 120. The openings 120 can be drilled or formed so as to that allow the flow of treating liquid out of the interior 118 of the spray tube 28. Without the nozzles 64 present to guide and direct the spray of the treating liquid, it is contemplated that the directionality of spray through the openings 120 can be determined by the angle at which the opening 120 is provided within the cylindrical body 100 of the spray tube 28. For example, some openings 120 can pass straight through the spray tube 28, perpendicular to the body axis 102, while other openings 120 can be provided at angles in order to direct the spray of treating liquid in a different direction. Any suitable combination of angles of the openings 120 can be employed. The openings 120, like the nozzles, can be provided in any suitable non-linear pattern, including the spiral pattern described above, or even in a linear pattern with varying angles of openings 120 such that the spray does not all leave the spray tube 28 in a uniform direction.

Figure 6:
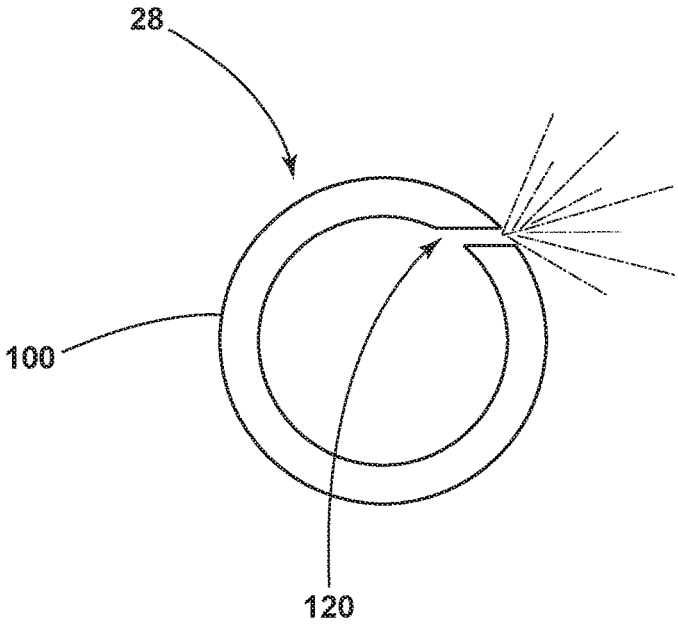
FIG. 6 is an enlarged, cross-sectional view of the rotating spray tube of FIG. 3 according to an embodiment of the invention.

FIG. 6 illustrates an enlarged cross-sectional view of a spray tube 28 according to an embodiment of the invention. In this embodiment, the spray tube 28 has a through opening 120 which wash liquid can pass through to exit the spray tube 28. The through opening has a centerline, which can form an angle relative to a tangent line on the surface of the spray tube 28. Ideally, this angle is zero degrees relative to the tangent line, which would result in the centerline being tangential to the surface. However, practically, a tangential centerline for the through opening is not physically possible. In most cases, the centerline will form a small angle, generally less than 10 degrees, relative to the tangent line.

The purpose of such a through opening 120 that has a centerline tangent to the surface or forming a small angle relative to a tangent line is for the liquid being emitted to impart a rotational force to the spray tube 28. These "tangent" through openings can be thought of a rotational through openings. Not all of the through openings need be "tangent" through openings to impart rotation to the tube.

In this case of "tangent" through openings, the center line of the through opening 120 does not pass through the longitudinal axis of rotation 102 of the spray tube 28. While the through opening 120 is illustrated herein as not being provided with a nozzle 64, it will be understood that a nozzle 64 could be inserted within the through opening 120 provided at the angle illustrated in FIG. 6. An orientation of the through opening 120 or nozzle 64 such as this could allow for the force of the spray of the wash liquid exiting the spray tube 28 to at least partially drive the rotation of the spray tube 28.

In a traditional dishwasher, spray assemblies can be a significant contributor to space constraints. Using a rotating spray tube rather than a spray arm reduces the height of the spray assemblies and allows for more usable space in the dish racks. However, rotating spray tubes that spray treating liquid in a single line from multiple nozzles cause a large volume of liquid to flow down the walls of the tub in a single wave, resulting in an over-accumulation of water in the sump that may exceed the capacity of the pump for removing the liquid from the sump. Further, the treating liquid flowing down the wall or walls of the tub in a single wave can also increase turbulence in the water gathered in the sump, resulting in the pump taking in air. Aspects of the present disclosure provide similar or improved performance to contemporary appliances without requiring additional mechanics or increased space within the dishwasher.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to an automatic cycle of operation, the dishwasher comprising:

a tub having at least one wall and at least partially defining a treating chamber with an access opening;

a sump fluidly coupled to the tub;

a liquid recirculation circuit fluidly coupling the sump to the treating chamber and including at least one rotating spray tube located adjacent the at least one wall, the at least one rotating spray tube comprising:

a hollow tube having a single wall and a longitudinal body axis defining a rotational axis; and a plurality of spray nozzles provided in the single wall of the at least one rotating spray tube, each of the spray nozzles comprising an inlet tube extending into an interior of the at least one rotating spray tube, each inlet tube having a single inlet opening and an angled or curved portion extending from each inlet tube further into the interior of the at least one rotating spray tube to define an end facing a liquid flow path through the at least one rotating spray tube and defining each single inlet opening, each of the angled or curved portions extending into the interior of the at least one rotating spray tube to an extent that the longitudinal body axis passes through each inlet opening and through the end of each angled or curved portion; and a pump configured to draw liquid from the sump and pump the drawn liquid to the at least one rotating spray tube;

wherein the spray nozzles are arranged in a spiral pattern about the longitudinal body axis on an exterior of the single wall of the at least one rotating spray tube such that a flow of liquid leaving the spray nozzles and running down the at least one wall to the sump does not exceed a capacity of the pump to draw the liquid from the sump.

2. The dishwasher of claim 1 wherein the at least one rotating spray tube further comprises a spiral channel and each spray nozzle is located in the spiral channel.

3. The dishwasher of claim 2 wherein the spiral channel makes at least one revolution about the at least one rotating spray tube.

4. The dishwasher of claim 1 wherein the at least one rotating spray tube has first and second opposing ends, with the first end fluidly coupled to the liquid recirculation circuit.

5. The dishwasher of claim 4 wherein the second end is higher than the first end.

6. The dishwasher of claim 4 wherein the second end comprises a drain valve and further wherein the drain valve is one of a flapper valve, a check valve, or a pressurized valve.

7. The dishwasher of claim 4 wherein the second end is plugged.

8. The dishwasher of claim 1 wherein each inlet opening faces the liquid flow path through the at least one rotating spray tube.

9. The dishwasher of claim 1 wherein the at least one rotating spray tube comprises multiple rotating spray tubes.

10. The dishwasher of claim 9 further comprising a dish rack located within the treating chamber and the multiple rotating spray tubes are located adjacent a portion of the dish rack.

11. The dishwasher of claim 10 wherein the portion of the dish rack is a bottom of the dish rack.

12. The dishwasher of claim 1 wherein the tub comprises at least two opposing walls and the at least one rotating tube comprises at least two rotating tubes, with each of the at least two rotating tubes being adjacent a different one of the at least two opposing walls.

13. The dishwasher of claim 12 further comprising a dish rack located adjacent the at least two rotating tubes.

14. The dishwasher of claim 13 wherein the at least two rotating tubes are located adjacent a bottom of the dish rack.

15. The dishwasher of claim 1 wherein the liquid recirculation circuit further comprises a supply tube extending along a wall of the tub, and fluidly connecting the pump to the at least one rotating spray tube.

16. The dishwasher of claim 15 wherein the liquid recirculation circuit further comprises a header fluidly coupling the supply tube to the at least one rotating spray tube.

17. The dishwasher of claim 1 wherein each inlet tube extends from an exterior of the single wall, through an opening in the single wall, and into the interior of the at least one rotating spray tube.

* * * * *